US007044796B2

(12) United States Patent
Tsai

(10) Patent No.: US 7,044,796 B2
(45) Date of Patent: May 16, 2006

(54) ELECTRICAL CONNECTOR HAVING TWO VERTICALLY MOVABLE BASES TO ENHANCE OVERALL LEVELNESS OF PINS

(76) Inventor: Chou Hsuan Tsai, 15F,No. 4, Lane 127, Sec. 1, Fu-Hsing Rd., Hsin-Chuang City (TW)

( * ) Notice: Subject to any disclaimer, the term of this patent is extended or adjusted under 35 U.S.C. 154(b) by 0 days.

(21) Appl. No.: 10/761,904

(22) Filed: Jan. 20, 2004

(65) Prior Publication Data

US 2004/0214474 A1 Oct. 28, 2004

(30) Foreign Application Priority Data

Jan. 30, 2003 (TW) ..... 092202122

(51) Int. Cl.
*H01R 24/00* (2006.01)

(52) U.S. Cl. ..... 439/630; 235/492

(58) Field of Classification Search ..... 439/630, 439/631; 235/492

See application file for complete search history.

(56) References Cited

U.S. PATENT DOCUMENTS 6,579,126 B1 * 6/2003 Narumo et al. ..... 439/630
6,612,492 B1 * 9/2003 Yen ..... 235/451
6,623,304 B1 * 9/2003 Harasawa et al. ..... 439/630
6,641,441 B1 * 11/2003 Liu ..... 439/630

* cited by examiner

*Primary Examiner*—Thanh-Tam Le
(74) *Attorney, Agent, or Firm*—Pro-Techtor Int'l Services

(57) ABSTRACT

An electrical connector having two vertically movable bases to enhance overall levelness of pins. The electrical connector includes a bottom base, a positioning structure, and a top base covering over the bottom base. The bottom base includes a mother base and a daughter base, wherein the mother base is formed with an opening, the daughter base is contained in the opening, one row of terminals is arranged on the daughter base, and each of the terminals has an elastic contact and a pin. The positioning structure is formed on the mother base and the daughter base to make the daughter base vertically movable and to horizontally restrict the daughter base in the opening of the mother base.

8 Claims, 6 Drawing Sheets

ELECTRICAL CONNECTOR HAVING TWO VERTICALLY MOVABLE BASES TO ENHANCE OVERALL LEVELNESS OF PINS

BACKGROUND OF THE INVENTION

1. Field of the Invention

The invention relates to an electrical connector, and more particularly to an electrical connector having two vertically movable bases to enhance overall levelness of pins, wherein the electrical connector has a bottom base divided into a daughter base and a mother base so that the welding effect between a circuit board and the bottom base may be improved.

2. Description of the Related Art

The electrical cards used in a computer include multimedia storage cards and memory cards, wherein the memory cards in the current market have various specifications, such as those of a Secure Digital Card (SDC), a Muti-Media Card (MMC), a Smart Media Card (SMC), a Memory Stick Card (MSC), a Compact Flash Card (CFC), and the like. Because the positions of connection points of the memory cards with different specifications are different, the electrical connectors for the memory cards with different specifications are different.

In order to facilitate the usage, the manufacturers try to integrate various kinds of electrical connectors into an integrated electrical connector suitable for various memory cards with different specifications. Because several memory cards with different specifications have to be integrated, the integrated electrical connector has to be provided with several kinds of terminals for the memory cards with different specifications. Thus, the number of the terminals is quite great, and the overall levelness of the pins of the terminals cannot be ensured to be 100%. Hence, the welding of the terminals has to be configured such that they can be repaired and welded. As shown in FIG. 1, for the sake of the repair welding, the pins 11 of the terminals horizontally protrude over two sides of the plastic base 12. Thus, when the electrical connector is welded to a mainboard, the repair welding process may be performed if some pins of the terminals are found to be in poor welded conditions.

The conventional memory card connector usually has pins of terminals protruding over the lateral sides of the base, and it is difficult to arrange a great number of terminals because the positions at two sides for the protruding pins as well as the space are limited. Furthermore, it is difficult to manufacture the connector as the interval between adjacent pins becomes smaller.

In order to meet the requirement of the repair welding, the pins of the terminals only can be arranged at two sides of the base, which is difficult to be achieved and the limited space also cannot accommodate more terminals. In addition, if the pins of the terminals are arranged at the wide bottom surface of the base, the repair welding process still cannot be performed. So, the prior art cannot effectively integrate various memory card connectors into an integrated connector suitable for various memory cards in a good production way.

SUMMARY OF THE INVENTION

It is therefore an object of the invention to provide an electrical connector having a bottom base divided into a mother base and a daughter base that may be moved vertically relative to each other so that the welding effect between the bottom base and a circuit board may be improved.

To achieve the above-mentioned object, the invention provides an electrical connector including a bottom base, a positioning structure, and a top base covering over the bottom base. The bottom base includes a mother base and a daughter base, wherein the mother base is formed with an opening, the daughter base is contained in the opening, one row of terminals is arranged on the daughter base, and each of the terminals has an elastic contact and a pin. The positioning structure is formed on the mother base and the daughter base to make the daughter base vertically movable and to horizontally restrict the daughter base in the opening of the mother base.

According to the above-mentioned structure, the pins of the terminals in the bottom base may be automatically adjusted when the bottom base is welded to the circuit board owing to the vertical floating effect of the daughter base with respect to the mother base, thereby improving the welding effect between the bottom base and the circuit board.

DETAILED DESCRIPTION OF THE INVENTION

Figure 1:
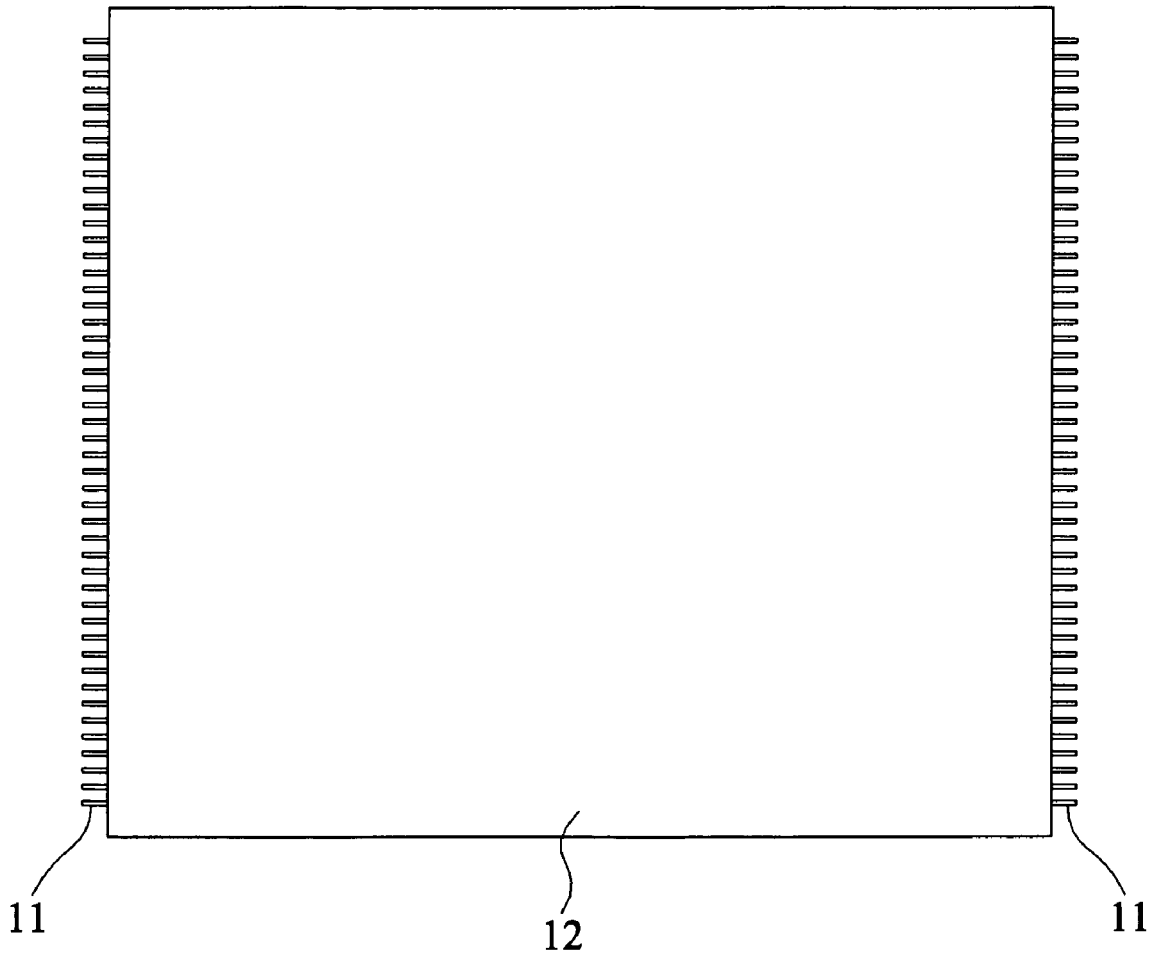
FIG. 1 (Prior Art)
FIG. 1 is a schematic top view showing a conventional electrical card connector.
Figure 2:
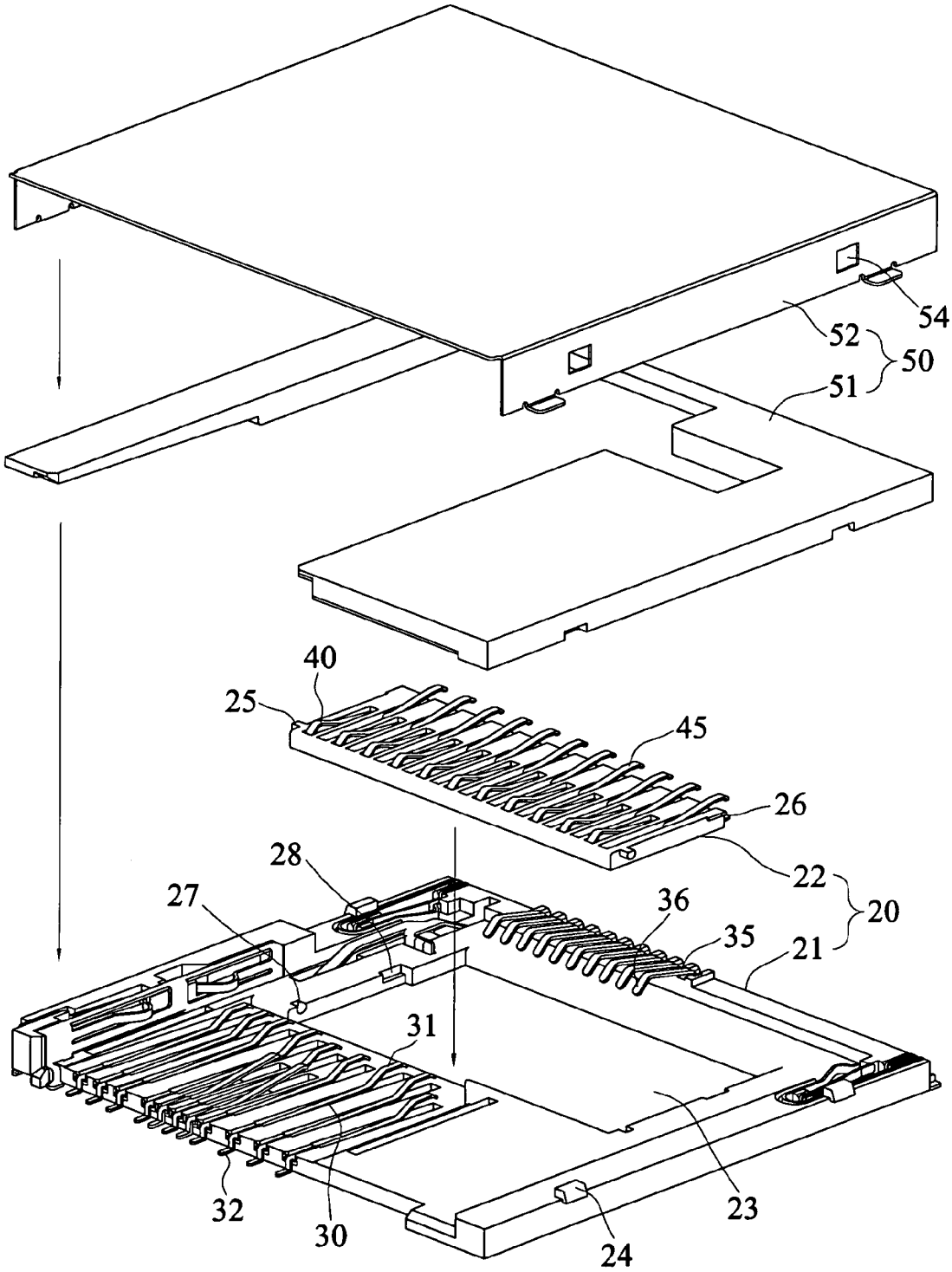
FIG. 2 is a pictorially exploded view showing a first embodiment of the invention.
Figure 3:
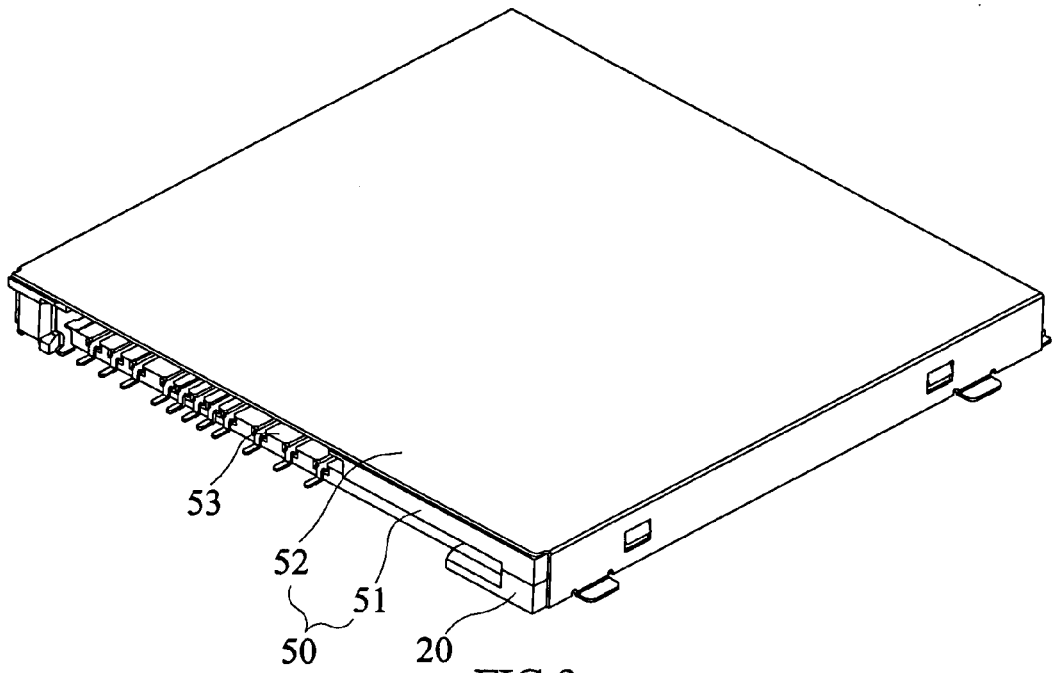
FIG. 3 is a pictorially assembled view showing the first embodiment of the invention.
Figure 4:
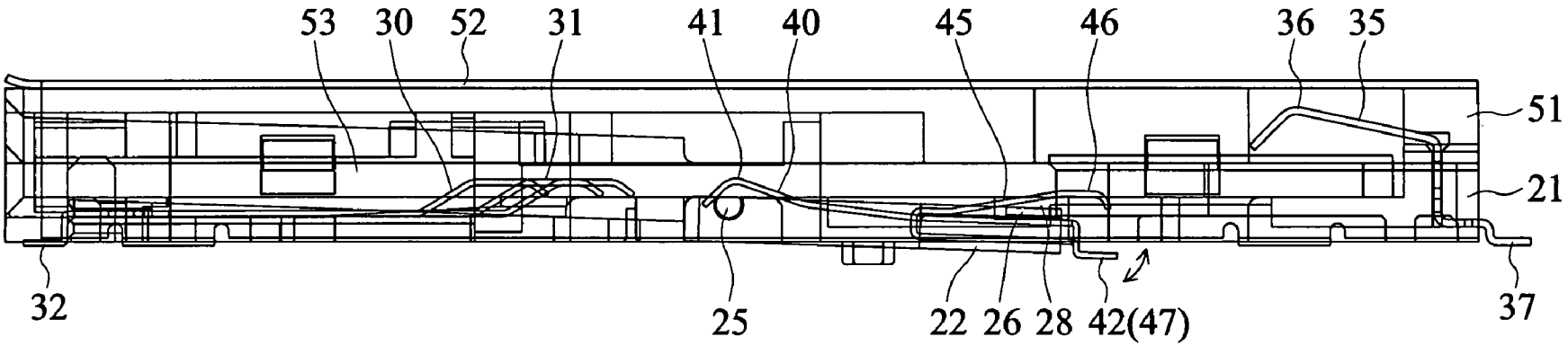
FIG. 4 is a schematically perspective illustration viewing from a side surface of the first embodiment of the invention.

Referring to FIGS. 2 to 4, an electrical card connector with multiple slots according to a first embodiment of the invention includes a bottom base 20, a positioning structure, one row of first terminals 30, one row of second terminals 35, one row of third terminals 40, one row of fourth terminals 45, and a top base 50.

The bottom base 20 includes a mother base 21 and a daughter base 22. The mother base 21 is formed with an opening 23 at a central portion thereof, and protruding engagement blocks 24 at two sides thereof. The daughter base 22 is contained in the opening 23.

Each first terminal 30 arranged on the mother base 21 has an elastic contact 31 located above the mother base 21 and a horizontal pin 32 located below the mother base 21 and protruding over a front end of the mother base.

Each second terminal 35 arranged on the mother base 21 has an elastic contact 36 located above the mother base 21 and a horizontal pin 37 located below the mother base 21 and protruding over a rear end of the mother base.

Each third terminal 40 arranged on the daughter base 22 has an elastic contact 41 located above the daughter base 22 and a horizontal pin 42 located below the daughter base 22 and protruding over a rear end of the daughter base 22, wherein the contact 41 is located above a front end of the daughter base 22.

Each fourth terminal 45 arranged on the daughter base 22 has an elastic contact 46 located above the daughter base 22 and a horizontal pin 47 located below the daughter base 22 and protruding over the rear end of the daughter base 22, wherein the contact 46 is located above the rear end of the daughter base 22.

The positioning structure includes two pivots 25 formed at two sides of the daughter base 22 at the front end opposite to the pins 42 and 47 of the third and fourth terminals, two flanges 26 at two sides of the daughter base 22 at the rear end close to the pins 42 and 47 of the third and fourth terminals, two pivotal holes 27 formed on the mother base 21 at positions corresponding to the pivots 25, and two recesses 28 formed on the mother base 21 at positions corresponding to the flanges 26. The flange 26 of the daughter base 22 may be moved substantially vertically in the recess 28, and the daughter base 22 is horizontally restricted in the opening 23 of the mother base 21. The pivot 25 of the daughter base 22 may serve as a fulcrum about which the daughter base 22 may be rotated. Thus, the flange 26 of the daughter base 22 can only be moved in a substantially vertical direction.

The top base 50 includes a top plate 51 and an upper cover 52 for covering the bottom base 20 to form a plurality of slots 53 with different widths or heights. The plurality of slots 53 shares a space, into which various electrical cards with different specifications may be individually inserted. The upper cover 52 is formed with engagement holes 54 at two side thereof. When the upper cover 52 covers the bottom base 20, the engagement blocks 24 at two sides of the mother base 21 may engage with the engagement holes 53 of the upper cover 52 so that the upper cover 52 and the bottom base 20 may be fixed.

The invention with the above-mentioned structure has the following advantages.

1. The plural rows of terminals may be separately arranged on the bottom base 20. That is, two rows of terminals (first and second terminals 30 and 35) may be arranged at the front end and the rear end, and two rows of terminals (third and fourth terminals 40 and 45) may be arranged at a central portion. Thus, the terminals may be arranged easily.

2. The pins 42 and 47 of the third and fourth terminals 40 and 45 are located at the central portion of the bottom base 20 and the welding thereof cannot be repaired after they are connected to the circuit board. However, because the daughter base 22 may be rotated and moved substantially vertically relative to the mother base 21, the third and fourth terminals 40 and 45 may be automatically adjusted by way of the floating function of the daughter base 22 such that the horizontal pins 32 of the first terminals 30, the horizontal pins 42 of the third terminals 40, the horizontal pins 37 of the second terminals 35 and the horizontal pins 47 of the fourth terminals 45 are located at the same level after the daughter base 22 is moved vertically, and the pins 42 and 47 may be well welded to the circuit board without the miss of welding. Thus, the welding effect between the circuit board and the daughter base 22 may be improved.

Figure 6:
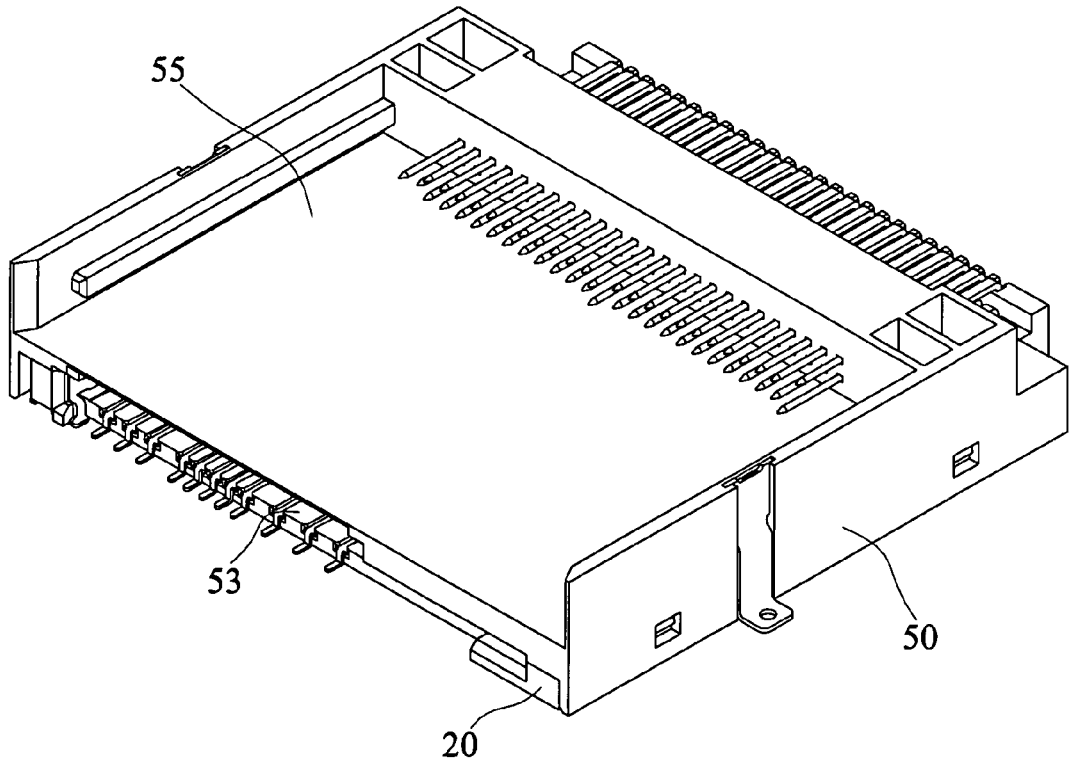
FIG. 6 is a pictorially assembled view showing the second embodiment of the invention.
Figure 5:
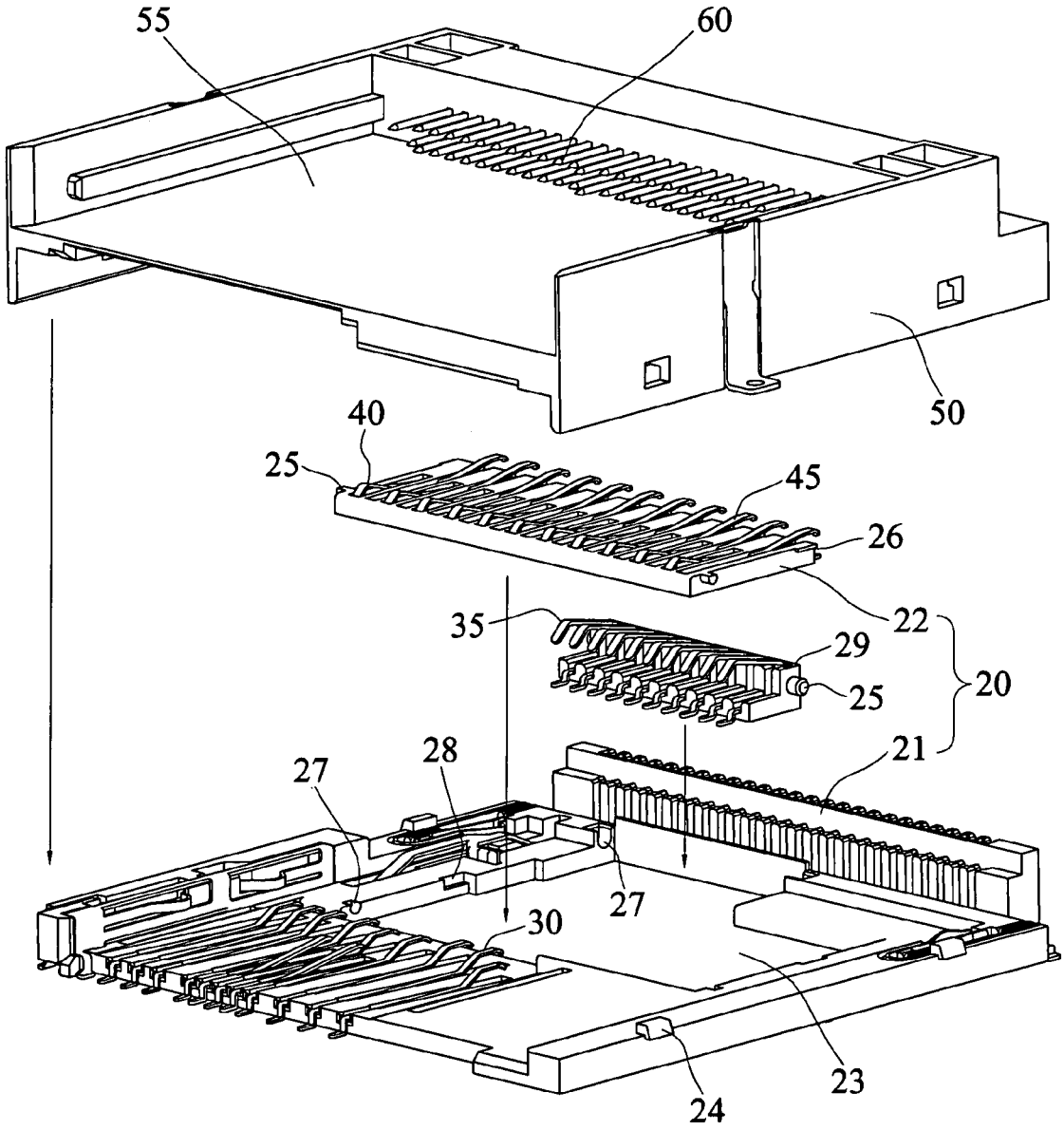
FIG. 5 is a pictorially exploded view showing a second embodiment of the invention.
Figure 7:
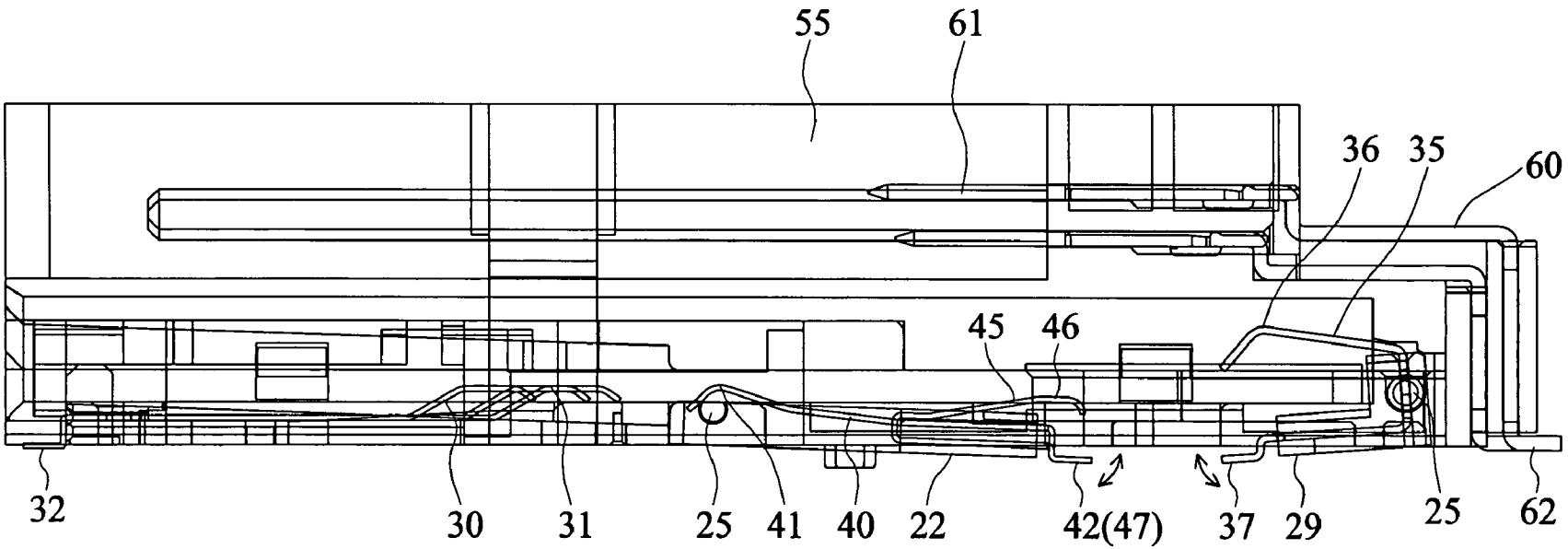
FIG. 7 is a schematically perspective illustration viewing from a side surface of the second embodiment of the invention.

Referring to FIGS. 5 to 7, the electrical card connector of the second embodiment includes a bottom base 20, a positioning structure, one row of first terminals 30, one row of second terminals 35, one row of third terminals 40, one row of fourth terminals 45, and a top base 50.

The bottom base 20 has a mother base 21 and two daughter bases 22 and 29. The mother base 21 is formed with an opening 23 at a central portion thereof and two protruding engagement blocks 24 at two sides thereof. The two daughter bases 22 and 29 are contained in the opening 23.

Each first terminal 30 arranged on the mother base 21 has an elastic contact 31 and a horizontal pin 32 protruding over a front end of the mother base 21.

Each second terminal 35 arranged on the daughter base 29 has an elastic contact 36 and a horizontal pin 37 protruding over a front end of the daughter base 29.

Each third terminal 40 arranged on the daughter base 22 has an elastic contact 41 and a horizontal pin 42 protruding over a rear end of the daughter base 22, wherein the contact 41 is positioned above the front end of the daughter base 22.

Each fourth terminal 45 arranged on the daughter base 22 has an elastic contact 46 and a horizontal pin 47 protruding over a rear end of the daughter base 22, wherein the contact 46 is positioned above the rear end of the daughter base 22.

The positioning structure includes two pivots 25 formed at two sides of the daughter base 22 at the front end opposite to the pins 42 and 47 of the third and fourth terminals, two flanges at two sides of the daughter base 22 at the rear end close to the pins 42 and 47, two pivotal holes 27 formed on the mother base 21 at positions corresponding to the pivots 25, and two recesses 28 formed on the mother base 21 at positions corresponding to the flanges 26. The flange 26 of the daughter base may be moved substantially vertically in the recess 28, and the daughter base 22 is horizontally restricted in the opening 23 of the mother base 21. The pivot 25 of the daughter base 22 may serve as a fulcrum about which the daughter base 22 may be rotated. Thus, the flange 26 of the daughter base 22 can only be moved in a substantially vertical direction. Similarly, the positioning structure also includes two pivots 25 formed at two sides of the daughter base 29 at an end opposite to the pins 37 of the second terminals, and two pivotal holes 27 formed on the mother base 21 at positions corresponding to the pivots 25. The pivot 25 of the daughter base 29 may serve as a fulcrum about which the daughter base 29 may be rotated. Thus, the end of the daughter base 29 close to the pins 37 can only be moved relative to the mother base 21 in a substantially vertical direction, and the daughter base 29 is horizontally restricted in the opening 23 of the mother base 21.

The top base 50 covers over the bottom base 20 to form a plurality of slots with different widths or heights. The slots 53 share a space, into which various electrical cards with different specifications may be individually inserted. The top base 50 is formed with engagement holes 54 at two sides thereof. When the top base 50 covers the bottom base 20, the engagement blocks 24 of the bottom base 20 may engage with the engagement holes 53 of the top base 50 so that the top base 50 and the upper cover 52 may be fixed. In addition, the top base 50 further has a top slot 55 at a top of the top base 50. Two rows of fifth terminals 60 are arranged in the top slot 55. Each fifth terminal 60 has a needle-like contact 61 in the top slot 55 and a horizontal pin 62 protruding over the rear end of the bottom base 20.

In this embodiment, a top slot 55 is further added to the top of the top base 50, and the pin 62 of the fifth terminal 60 has to extend toward the rear end of the bottom base 20. So, the pin 37 of the second terminal 35 of this embodiment only has to extend toward the inside of the bottom base 20. Since the second terminal 35 is arranged on the daughter base 29, the welding effect between the circuit board and the second terminals 35 may be improved owing to vertical floating effect of the daughter base 29 relative to the mother base 21.

The pins of the terminals of the embodiments are of the horizontal type, which tends to cause the poor welding effect that may be solved by the invention. In addition, if the pins of the terminals are of the solder ball type, a good welding effect may be obtained. However, using the design of this invention may have a better welding effect.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. An electrical connector, comprising:

a bottom base including a mother base and a daughter base, wherein the mother base is formed with an opening, and the daughter base is contained in the opening;

a row of first terminals attached to the mother base, each of the first terminals has an elastic contact located above the mother base and a horizontal pin located below the mother base;

a row of third terminals attached to the daughter base, each of the third terminals has an elastic contact located above the daughter base and a horizontal pin located below the daughter base;

a positioning structure formed on the mother base and the daughter base to make the daughter base vertically movable and to horizontally restrict the daughter base in the opening of the mother base, such that the horizontal pins of the first terminals and the horizontal pins of the third terminals are located at the same level after the daughter base is moved vertically; and a top base covering over the bottom base.

2. The electrical connector according to claim 1, wherein:

the horizontal pins of the third terminals protrude over a rear end of the daughter base; and the positioning structure comprises:

pivots formed at two sides of the daughter base at a front end opposite to the rear end of the daughter base; and pivotal holes formed on the mother base at positions corresponding to the pivots such that the rear end of the daughter base may be moved vertically relative to the mother base when the daughter base is rotated about the pivots.

3. The electrical connector according to claim 1, further comprising a row of second terminals attached to the mother base, each of the second terminals having an elastic contact located above the mother base and a horizontal pin located below the mother base, wherein the horizontal pins of the first terminals, the horizontal pins of the third terminals, and the horizontal pins of the second terminals are located at the same level after the daughter base is moved vertically.

4. The electrical connector according to claim 1, further comprising a row of fourth terminals attached to the daughter base, each of the fourth terminals having an elastic contact located above the daughter base and a horizontal pin located below the daughter base, wherein the horizontal pins of the first terminals, the horizontal pins of the third terminals and the horizontal pins of the fourth terminals are located at the same level after the daughter base is moved vertically.

5. The electrical connector according to claim 1, wherein the top base has a top slot at a top thereof, and a row of fifth terminals is arranged in the top slot.

6. The electrical connector according to claim 1, wherein the top base covers the bottom base to form a plurality of slots with different widths or heights, and the plurality of slots share a space.

7. The electrical connector according to claim 3, further comprising a row of fourth terminals attached to the daughter base, each of the fourth terminals having an elastic contact located above the daughter base and a horizontal pin located below the daughter base, wherein the horizontal pins of the first terminals, the horizontal pins of the third terminals, the horizontal pins of the second terminals and the horizontal pins of the fourth terminals are located at the same level after the daughter base is moved vertically.

8. The electrical connector according to claim 2, wherein:

the mother base is formed with a recess; and the daughter base is formed with a flange, which may be moved vertically in the recess.

* * * * *